US006526251B1

(12) United States Patent
Otsuka et al.

(10) Patent No.: US 6,526,251 B1
(45) Date of Patent: Feb. 25, 2003

(54) IMAGE FORMING APPARATUS HAVING TRANSFERRING ROLLER OF SMALL DIAMETER

(75) Inventors: Yasumasa Otsuka, Yokohama (JP); Koichi Otaka, Toride (JP); Daizo Fukuzawa, Matsudo (JP); Yoshiyuki Yamazaki, Toride (JP); Hisashi Nakahara, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/680,975

(22) Filed: Oct. 6, 2000

(30) Foreign Application Priority Data

Oct. 12, 1999 (JP) ..... 11-289803

(51) Int. Cl.[7] ..... G03G 15/16
(52) U.S. Cl. ..... 399/313
(58) Field of Search ..... 399/121, 116, 399/159, 313

(56) References Cited

U.S. PATENT DOCUMENTS 5,406,360 A * 4/1995 Asai ..... 399/313
5,819,149 A 10/1998 Watanabe et al. ..... 399/330

* cited by examiner

*Primary Examiner*—Hoang Ngo
(74) *Attorney, Agent, or Firm*—Fitzpatrick, Cella, Harper & Scinto

(57) ABSTRACT

The present invention provides an image forming apparatus, which has a roller-shaped image bearing member bearing a toner image thereon, and a transferring roller pressure-contacted with the image bearing member for transferring the toner image on the image bearing member to a transferring material, a radius of the transferring roller being 12 mm or less, wherein r/R<0.4 where r is the radius of the transferring roller, and R is the radius of the image bearing member.

3 Claims, 6 Drawing Sheets

IMAGE FORMING APPARATUS HAVING TRANSFERRING ROLLER OF SMALL DIAMETER

BACKGROUND OF THE INVENTION

1. Field of the Invention

This invention relates to an image forming apparatus such as a printer, a copier or a facsimile apparatus utilizing the electrophotographic method or the electrostatic recording method.

2. Related Background Art

Many of image forming apparatus utilizing the electrophotographic method adopt a contact type charging method and a contact type transferring method which are low in the production of harmful ozone, and above all, in the transferring portions thereof, the mainstream is a roller transferring method excellent in the convey ability of a transferring material such as paper.

Now, the roller transferring method is a method of urging a transferring roller having an elastic rubber roller layer against an electrophotographic photosensitive body (hereinafter referred to as the photosensitive drum) which is an image bearing body to thereby form a transfer nip, and transferring a toner image on the photosensitive drum to the transferring material by the action of a transfer bias applied to the transferring roller while conveying the transferring material by the transfer nip. As the transferring roller, use is generally made of an elastic sponge roller of hardness 20 to 40 degrees (Asker-C) comprising a mandrel of SUS, Fe or the like and an electrically semiconductive sponge elastic layer formed thereon and having its resistance adjusted to $1\times10^{6}$ to $1\times10^{10}\Omega$ by a carbon or ion electrically conductive filler or the like.

However, a transferring roller having a diameter about half that of the photosensitive drum has heretofore been used. Accordingly, even in a transferring roller in which the ratio of the transferring roller diameter/the photosensitive drum diameter (hereinafter referred to as the diameter ratio) is small, for example, the diameter of the transferring roller is 14 mm relative to the diameter of 30 mm of the photosensitive drum, and the diameter ratio is 14/30≅0.47, and in many apparatuses, the diameter ratio is 0.5 or greater. This is because in the manufacture of the transferring roller, electrically semiconductive foamed rubber is polished after formed around a mandrel, whereby the diameter thereof is adjusted, and the reason for polishing is that the accuracy of ±0.1 mm or less is required because the transferring roller affects the conveyability of the transferring material.

In the method of adjusting the diameter of the transferring roller by polishing, there has been the problem that a grinder traverses in the axial direction of the roller and therefore, if the rigidity of the mandrel is low, the mandrel is flexed and a diameter difference occurs between the end portion and center of the roller and thus, the direction of conveyance differs between the center and end portion and the transferring material becomes wrinkled.

Also, to increase the restraining force at the nip portion of the transferring roller in order to eliminate the blur of an image, Asker-C hardness of 40 degrees or less is required, and for this reason, a method of foaming rubber and thickening the elastic rubber roller layer has been adopted.

However, when transfer is effected in a state in which the diameter ratio is great, there has been the problem that when the transferring material comes into the transfer nip and when it is discharged therefrom, the scattering of the image occurs under the influence of the electric field of the transferring roller and the gradation of the halftone is aggravated or the line image becomes blurred.

SUMMARY OF THE INVENTION

It is an object of the present invention to provide an image forming apparatus in which a toner image is little scattered.

It is another object of the present invention to provide an image forming apparatus which can use a transferring roller of a small diameter.

It is still another object of the present invention to provide an image forming apparatus comprising:

a roller-shaped image bearing member bearing a toner image thereon; and a transferring roller pressure-contacted with the image bearing member for transferring the toner image on the image bearing member to a transferring material, a radius of the transferring roller being 12 mm or less;

wherein $$r/R<0.4,$$

where r is the radius of the transferring roller, and R is the radius of the image bearing member.

Further objects of the present invention will become apparent from the following description.

DESCRIPTION OF THE PREFERRED EMBODIMENTS

An embodiment of the present invention will hereinafter be described with reference to the accompanying drawings.

Figure 1:
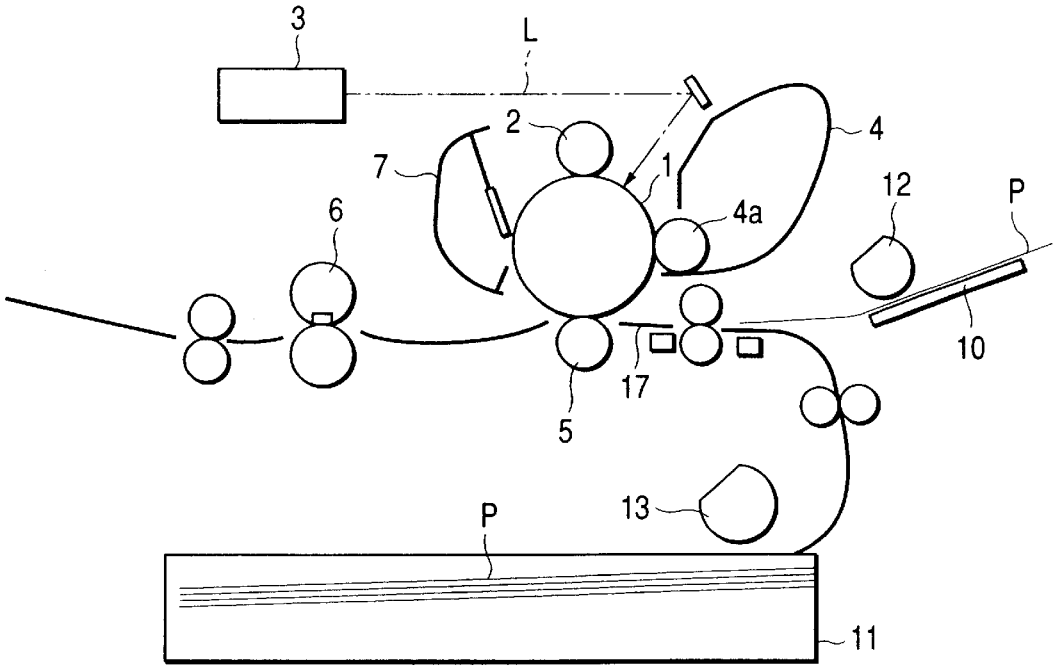
FIG. 1 is a cross-sectional view showing the basic construction of an image forming apparatus according to the present invention.

Referring to FIG. 1 which is a crosssectional view showing the basic construction of an image forming apparatus according to the present invention, the reference numeral 1 designates a photosensitive drum as an image bearing member, the reference numeral 2 denotes a charging roller, the reference numeral 3 designates an exposing apparatus (laser scanner), the reference numeral 4 denotes a developing apparatus, the reference numeral 5 designates a transferring roller, the reference numeral 6 denotes a fixing apparatus, and the reference numeral 7 designates a cleaning apparatus.

The photosensitive drum 1 comprises a cylinder-shaped base body formed of aluminum, nickel or the like and having a photosensitive material such as OPC or amorphous silicon formed thereon, and is rotatively driven at a predetermined process speed.

The charging roller 2 is urged against the surface of the photosensitive drum 1 with a predetermined pressure force and is rotated following the rotative driving of the photosensitive drum 1, and a predetermined charging bias is applied from a charging bias voltage source, not shown, to the charging roller 2, whereby the photosensitive drum 1 is charged to a predetermined polarity and potential.

The exposing apparatus 3 effects exposure by a laser beam L on the charged photosensitive drum 1 in conformity with inputted image information to thereby form an electrostatic latent image on the photosensitive drum 1.

Now, in the present embodiment, the developing apparatus 4 is a reversal developing apparatus having a developing sleeve 4*a,* and a developing bias is applied from a developing bias voltage source, not shown, to the developing sleeve 4*a.*

Also, the transferring roller 5 constitutes contact transferring means of a roller transferring type having a solid-like elastic layer formed on a mandrel, and a transferring bias is applied from a transferring bias power source, not shown, to the transferring roller 5.

The action of this image forming apparatus will now be described.

During image formation, the photosensitive drum 1 is rotatively driven at the predetermined process speed by driving means, not shown, and the predetermined charging bias is applied to the charging roller 2, whereby the surface of the photosensitive drum 1 is charged.

Thus, the laser beam L is ON/OFF-controlled and scanned on the charged surface of the photosensitive drum 1 from the exposing apparatus 3 in conformity with image information, whereby an electrostatic latent image is formed on the photosensitive drum 1. This electrostatic latent image is developed by the developing apparatus 4 and visualized as a toner image.

On the other hand, transferring materials P such as paper are taken out one by one from a manually feeding tray 10 or a cassette 11 by a sheet feeding roller 12 or 13, and the transferring material P thus taken out is supplied along a pre-transfer guide 17 to a transfer nip portion (transferring portion) formed by the photosensitive drum 1 and the transferring roller 5 with the leading end thereof synchronized with the toner image formed on the surface of the photosensitive drum 1. At the transfer nip portion, the toner image on the photosensitive drum 1 is transferred to the transferring material P by the transferring roller 5 to which the transferring bias has been applied.

The transferring material P to which the toner image has thus been transferred is conveyed to the fixing apparatus 6, and is heated and pressed by the nip portion of the fixing apparatus 6, whereby the toner image is fixed as a permanently secured image on the transferring material P, and the transferring material P on which the toner image has been fixed is discharged to the outside of the apparatus. Any untransferred toner residual on the photosensitive drum 1 after the transfer is removed from the photosensitive drum 1 by the cleaning apparatus 7.

Figure 2:
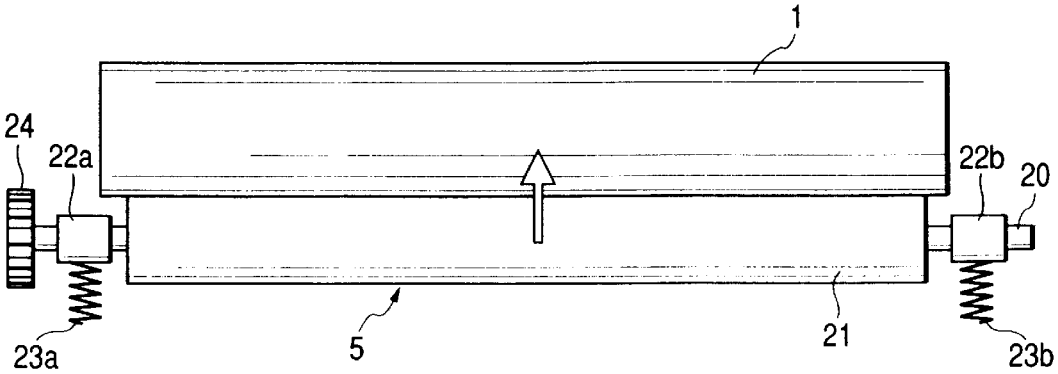
FIG. 2 is a front view showing the mounted state of the transferring roller of the image forming apparatus according to the present invention.

Now, the transferring roller 5, as shown in FIG. 2, is a solid rubber roller comprising a mandrel 20 formed of SUS, Fe or the like and having a diameter of 6 mm or less, and a solid-like elastic layer 21 of EPDM, silicone, NBR, urethane or the like formed thereon, and the roller hardness thereof 40 degrees (Asker-C/1 kg. load) and the resistance value thereof may suitably be within the range of $1\times10^{6}$ to $1\times10^{10}\Omega$.

In FIG. 2, the reference numeral 24 designates a driving gear, and the reference characters 22*a* and 22*b* denote bearings, one of which has electrical conductivity, and the transferring roller 5 is pressed against the photosensitive drum 1 by springs 23*a* and 23*b*.

Here, description will be made of a transferring roller 5 using EPDM as the elastic layer.

Figure 3:
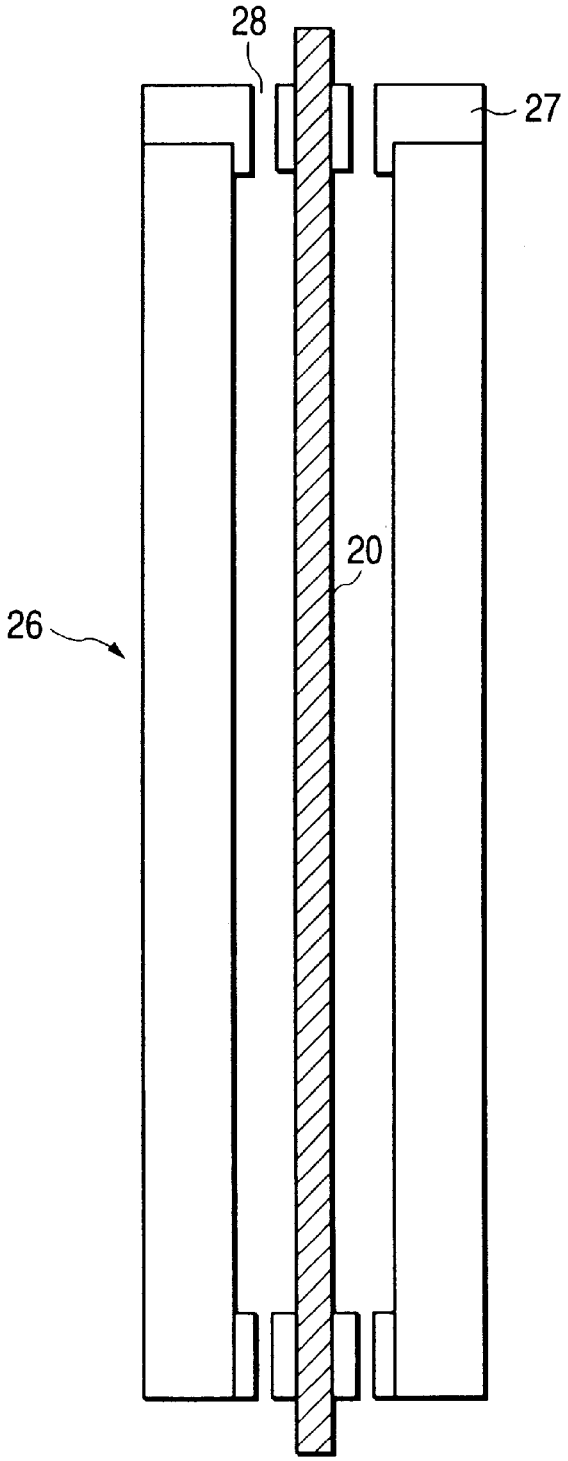
FIG. 3 is a cross-sectional view of a metal mold for molding the transferring roller of the image forming apparatus according to the present invention.

The transferring roller 5 of this kind is molded by injecting a compound of the following composition into a metal mold 26 shown in FIG. 3 and foaming it.

(prescription)

| | |
|---|---|
| EPDM | 100 parts by weight |
| zinc oxide | 5 parts by weight |
| higher fatty acid | 1 part by weight |
| electrically conductive carbon black | 10 parts by weight |
| paraffin group oil | 50 parts by weight |
| vulcanizing agent | 2 parts by weight |
| vulcanization accelerator | 4 parts by weight |
| foaming agent | 10 parts by weight |

A mandrel 20 made of SUS (having a length of 230 mm and a diameter of 6 mm was centrally disposed in a cylindrical metal mold 26 having an inner diameter of 12 mm and an inner surface length of 220 mm, and the compound was injected through an injection port 28 formed in a metal cap 27, and this compound was foamed to thereby obtain a sponge roller of EPDM. The nip resistance (the resistance when DC 2000V was applied and a load of 1 kg was made to act on the mandrel) of the EPDM sponge roller obtained in this manner was $2\times10^{9}\Omega$ at a temperature of 10°

C. and humidity of 80%RH, $9\times10^8\Omega$ at a temperature of 23.5° C. and humidity of 60%RH, and $7\times10^8\Omega$ at a temperature of 32.5° C. and humidity of 80%RH. Also, the hardness of the foamed material was 34 degrees (Asker-C) for the product.

Figure 4:
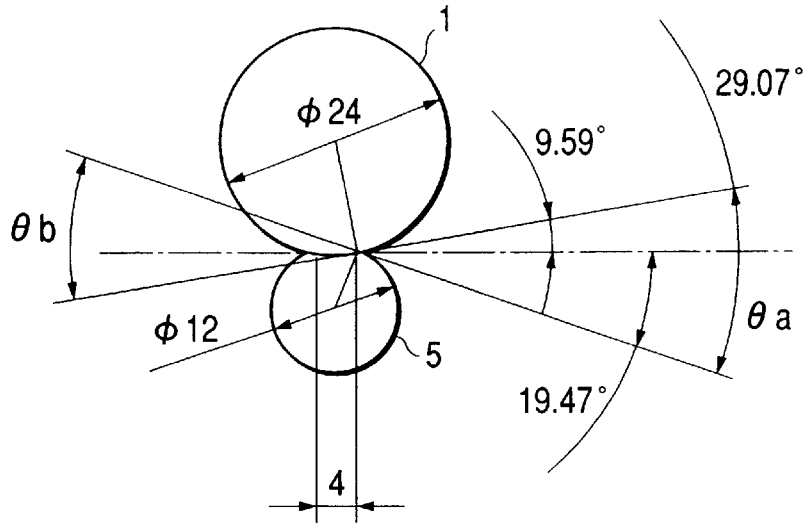
FIG. 4 is a cross-sectional view of a photosensitive drum and a transferring drum showing the angle of entry into a transfer nip in the image forming apparatus according to the present invention.

When this transferring roller 5 is pressed against the photosensitive drum 1 having a diameter of 24 mm with total pressure of 11.77 N, a transfer nip is formed with a width of about 4 mm. At this time, the angle of entry θa and angle of discharge θb of the nip portion formed by the transferring roller 5 and the photosensitive drum 1 are 29° or greater as shown in FIG. 4. Therefore, the transferring material could be directed to the transfer nip while being twining on the photosensitive drum 1 with a sufficient space for the entry of the transferring material, and an image suffering little from scattering and excellent in the gradation of the halftone could be formed.

Also, a sufficient width of 4 mm was obtained for the transfer nip and therefore, the deviation of the transferring material did not occur and blur neither occurred. The transferring roller 5 was molded with the dimensions of the metal mold 26 and the polishing thereof was not necessary, and further it become possible to mold so that the outer diameter might be 10 mm for a mandrel of a small diameter (e.g. a diameter of 4 mm).

Figure 5:
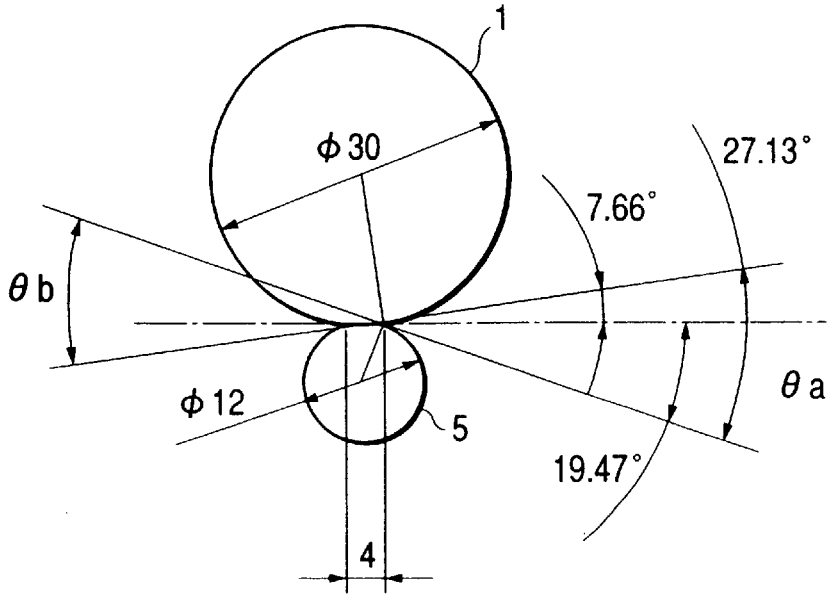
FIG. 5 is a cross-sectional view of a photosensitive drum and a transferring drum showing the angle of entry into the transfer nip in the image forming apparatus according to the present invention.

When the transferring roller 5 of such a small diameter of 12 mm or less is brought into contact with the photosensitive drum 1 of a diameter of 30 mm or less, the angle of entry θa and the angle of discharge θb with respect to the transfer nip portion can be 27° or greater as shown in FIG. 5 and therefore, the influence of the electric field of the transferring roller 5 upon an image can be restrained more easily.

Also, the pre-transfer guide can be disposed with a spatial margin, and the best conveyance in terms of the quality of image in which the transferring material is supplied to the transfer nip after the transferring material is twined on the photosensitive drum becomes possible.

COMPARATIVE EXAMPLE

Figure 6:
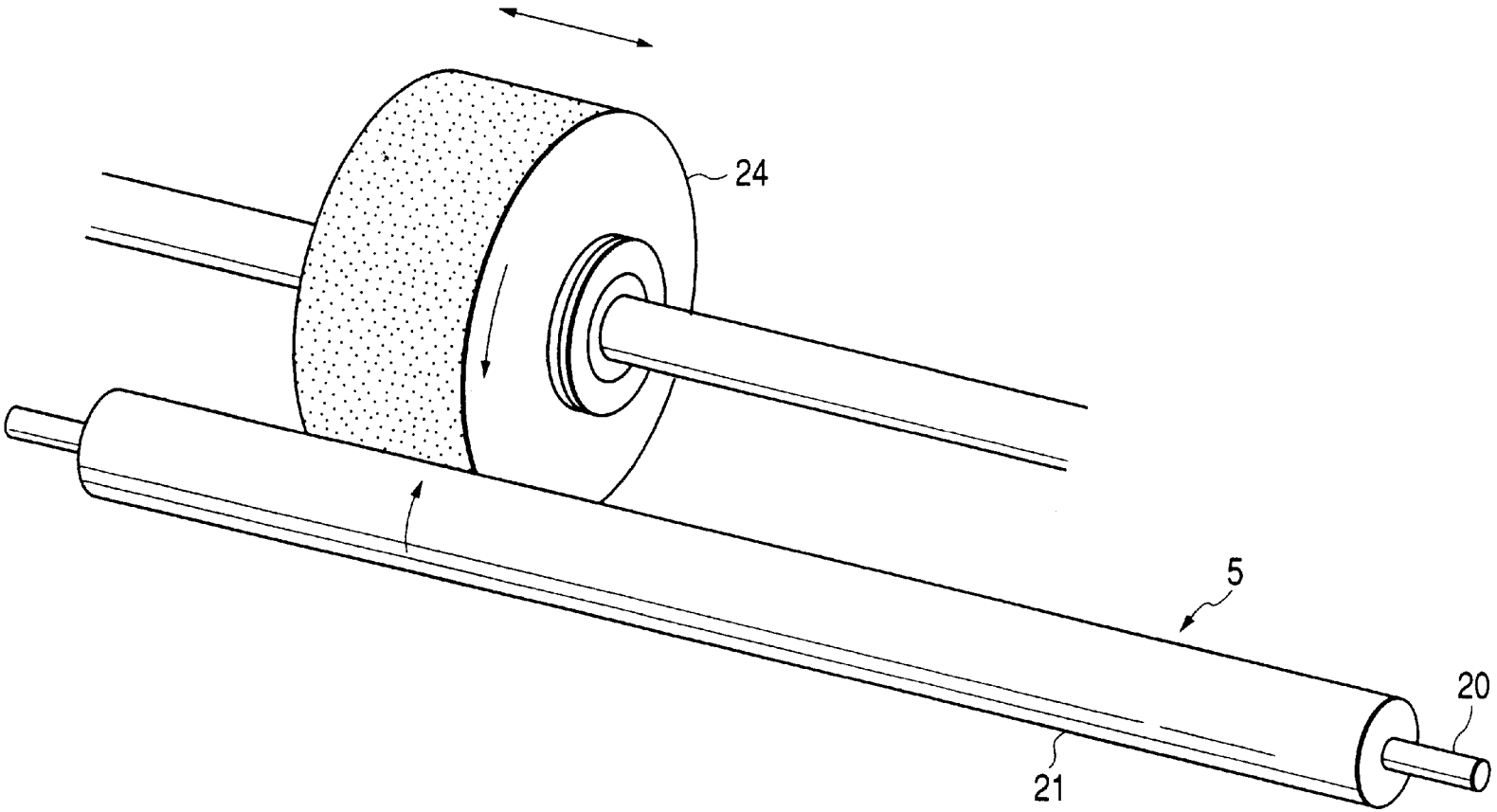
FIG. 6 is a perspective view showing a method of polishing a transferring roller according to the prior art.

On the other hand, in the conventional method of manufacturing a transferring roller by electrically conductive EPDM, a composition in which paraffin group oil was decreased to 4 parts by weight from the aforedescribed prescription was kneaded and cut into a moderate length while being extruded into the form of a tube, and was foamed in a steam pot, whereafter a mandrel was forced into a sponge tube. Thereafter, it was polished by a rotary type polishing machine shown in FIG. 6 while both of a grinder 24 and the transferring roller 5 were rotated, thereby providing a desired diameter.

In the above-described method, if the diameter of the mandrel 20 is 6 mm or less, flexure occurs to even the mandrel 20 of SUS or Fe due to the pressure acting during the polishing and therefore, a uniform outer diameter cannot be obtained in the outer and end portions of the mandrel 20.

Also, to secure a wide transfer nip in order to prevent the blur of an image, the product hardness of the roller must be reduced, and for that purpose, the thickness of foamed rubber need be 4 mm or greater. Incidentally, when the foaming rate is increased and the hardness is reduced, there arises the problem that the surface becomes roughened and uniform charging cannot be effected on the back of the transferring material and therefore a coarse image in halftone appears. For these reasons, the lower limit value of the diameter was 14 mm.

Figure 7:
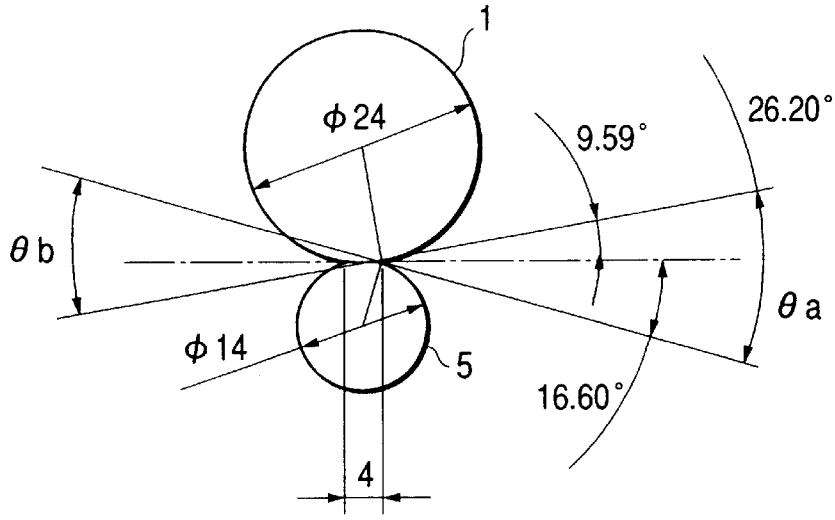
FIG. 7 is a cross-sectional view of a photosensitive drum and a transferring drum showing the angle of entry into a transfer nip in an image forming apparatus according to the prior art.
Figure 9:
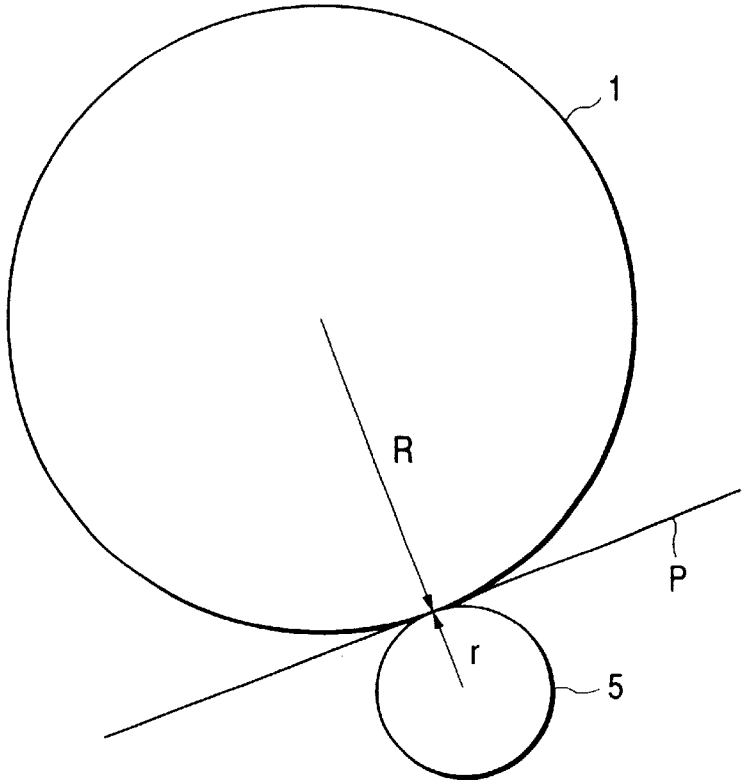
FIG. 9 is a cross-sectional view showing the relation between the photosensitive drum and transferring roller of the image forming apparatus according to the present invention.

When this transferring roller 5 was used with a photosensitive drum 1 having a diameter of 24 mm, the angle of entry θa and angle of discharge θb of the nip were 26.2° or less as shown in FIG. 7.

According to this, as compared with the aforedescribed Embodiment 1, the transferring material was strongly affected by the electric field of the transferring roller before and after it entered the transfer nip, and the image thereon was liable to scatter, and the reproducibility of the halftone became bad. Thus comparing Embodiment 1 and this comparative example with each other, the transferring roller may be of solid rubber having a diameter of 12 mm or less if it can be made low in hardness.

For the prevention of humidity, use may be made of such a roller having its surface thin-layer-coated with epichlorohydrin rubber, or hardened with the bridging of urethane progressed by ultraviolet rays being applied thereto.

Another transferring roller used in the present invention will now be described.

Figure 8:
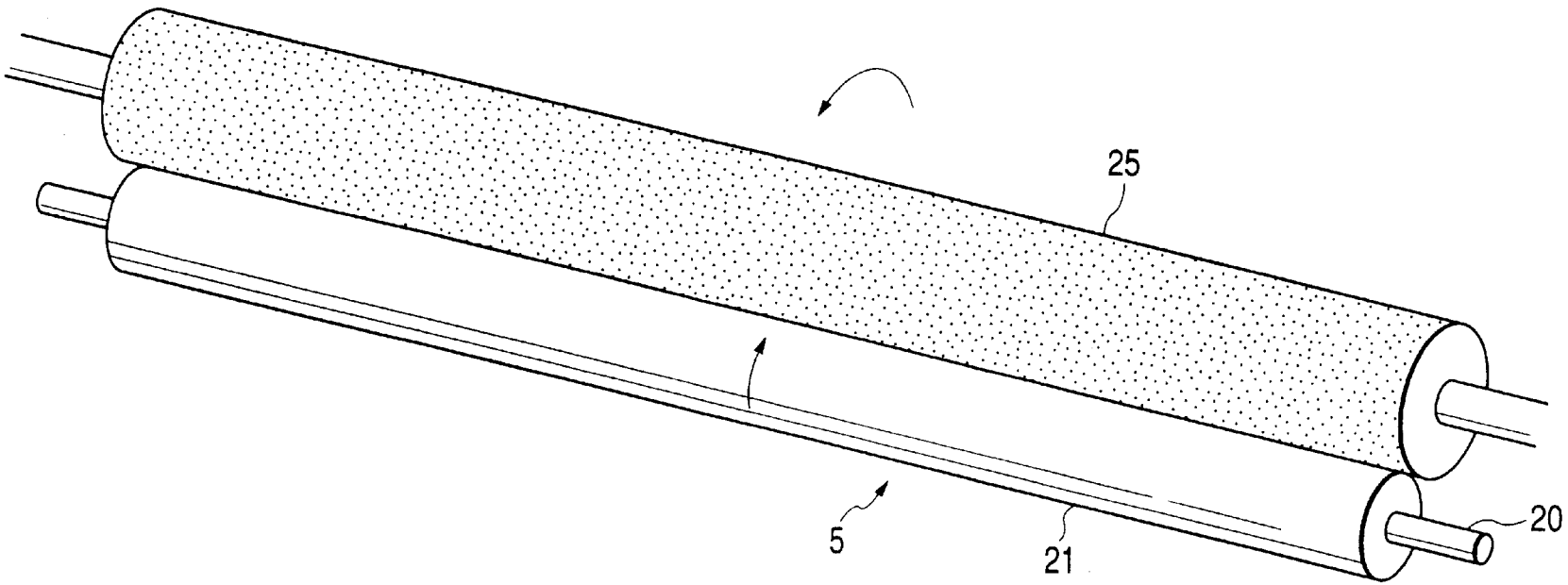
FIG. 8 is a perspective view showing a method of polishing the transferring roller of the image forming apparat according to the present invention.

While the aforedescribed transferring roller was molded by the metal mold, the dimensions of the transferring roller may be provided by a method using such a long grinder 25 for polishing the whole rubber surface length of the transferring roller 5 at a time as shown in FIG. 8. In this case, as in the aforedescribed comparative example, tube-shaped sponge rubber once foamed is made to cover a mandrel, and thereafter is polished by a polishing machine shown in FIG. 8.

In an experiment, a compound of EPDM was foamed into a tube shape having a diameter of 20 mm, an outer diameter of 3.5 mm and a length of 220 mm so as to assume Asker-C hardness of 34 degrees and was forced into a mandrel of 4 mm, and polishing was effected under the aforedescribed conditions. As the result, the difference in outer diameter by flexure was not seen relative to the entire rubber surface length.

In such a polishing method, pressure is applied to the entire length at a time and therefore flexure is prevented, and it becomes possible to use a mandrel of a small diameter and accordingly it is possible to provide a diameter of 12 mm or less.

As compared with the molding by the metal mold, this method has the advantages that it is easy to provide the accuracy of the diameter and that it is easy to control the conveying force because polishing points are formed on the surface.

Also, it is possible to save the trouble of cleaning the metal mold and design the steps into ones of good productivity.

Further, depending on rubber, a manufacturing method of foaming silicone rubber simultaneously with extruding it is also possible, and in this case, the further simplification of the steps can be achieved.

The influence of an electric field upon the transferring material entering the transfer nip is greatly changed by the ratio between the diameters of the photosensitive drum and the transferring roller.

In the prior art, the outer diameter of the transferring roller was determined from the aforedescribed problem in the manufacture but from such a viewpoint of electric field, to reduce the influence of the electric field of the transferring roller 5 when as shown in FIG. 1, for at least a photosensitive drum 1 having an outer diameter of 30 mm or less, the radius r of the transferring roller 5 is defined relative to the radius R of the photosensitive drum 1, it is a conclusion obtained from the results of the aforedescribed Embodiments 1 and 2 that it is preferable that r/R<0.4. It is desirable that the hardness of the transferring roller 5 in this case be 40 degrees or less and design be made such that a transfer nip of 2 mm to 4 mm is secured. As mentioned above, to make the nip width 4mm or less, it is preferred to make the total pressure 11.77 N or less.

While the embodiments of the present invention have been described above, the present invention is not restricted to these embodiments, but all modifications are possible within the technical idea of the present invention.

What is claimed is:

1. An image forming apparatus comprising:

a roller-shaped image bearing member bearing a toner image thereon; and a transferring roller pressure-contacted with said image bearing member for transferring the toner image on said image bearing member to a transferring material, a diameter of said transferring roller being 12 mm or less;

wherein $$r/R<0.4,$$

where r is said radius of the transferring roller, and R is the radius of said image bearing member, so that an angle of entry and angle of discharge of the transferring material with respect to the transfer nip portion is at least 27 degrees.

2. An image forming apparatus according to claim 1, wherein said transferring roller has a core material and a rubber layer provided on the core material, and an Asker-C hardness of the rubber layer is 40 degrees or less.

3. An image forming apparatus according to claim 1, wherein a pressure contact force of said transferring roller against said image bearing member is 11.7 N or less in total pressure.

* * * * *

UNITED STATES PATENT AND TRADEMARK OFFICE

CERTIFICATE OF CORRECTION

PATENT NO. : 6,526,251 B1
DATED : February 25, 2003
INVENTOR(S) : Yasumasa Otsuka et al.

It is certified that error appears in the above-identified patent and that said Letters Patent is hereby corrected as shown below:

Column 1,
Line 14, “of” should read -- of the --, and “apparatus” should read -- apparatuses --.
Line 46, “14/30≅0.47,” should read -- 14/30≅0.47, --.
Line 50, “after “ should read -- after being --.

Column 2,
Line 67, “rat” should read -- ratus --.

Column 5,
Line 14, “twining” should read -- twined --.
Line 25, “become” should read -- becomes --.

Column 6,
Line 42, “As the” should read -- As a --.

Signed and Sealed this

Seventh Day of October, 2003

JAMES E. ROGAN
*Director of the United States Patent and Trademark Office*